US005165275A

United States Patent [19]

Donovan

[11] Patent Number: 5,165,275

[45] Date of Patent: Nov. 24, 1992

[54] COMPENSATED GAMMA RAY MUDLOG

[75] Inventor: William S. Donovan, Littleton, Colo.

[73] Assignee: Donovan Brothers, Inc., Littleton, Colo.

[21] Appl. No.: 535,333

[22] Filed: Jun. 7, 1990

[51] Int. Cl.[5] ..... G01V 5/04

[52] U.S. Cl. ..... 73/153; 73/151; 250/254

[58] Field of Search ..... 73/151, 153; 250/253, 250/254, 285; 175/40, 41, 50

[56] References Cited

U.S. PATENT DOCUMENTS

| | | | |
|---|---|---|---|
| 2,214,674 | 9/1940 | Hayward | 250/254 X |
| 2,528,955 | 11/1950 | Hayward | 175/41 |
| 3,802,259 | 4/1974 | Eckels | 73/153 |
| 3,831,082 | 8/1974 | Muzzagatti | 73/153 X |
| 4,578,579 | 3/1986 | Dion | 250/253 X |

*Primary Examiner*—Tom Noland
*Assistant Examiner*—Michael Brock
*Attorney, Agent, or Firm*—Beaton & Swanson

[57] ABSTRACT

A method and apparatus for measuring the gamma radiation levels of drilling mud expelled from an oil and gas bore hole to determine the composition of the earth at the bottom of the bore hole and, when used in conjunction with a Measurement While Drilling gamma radiation detector, to determine the time and location of bore hole cavings. A first gamma radiation detector measures the gamma radiation level of the drilling mud with the bore hole entrained material, and a second gamma radiation detector measures the gamma radiation of the drilling mud without the entrained material. The difference between the two measurements is lagged to the time between the detectors and the bore hole bottom.

10 Claims, 6 Drawing Sheets

COMPENSATED GAMMA RAY MUDLOG

FIELD OF THE INVENTION

This invention relates to wells drilled in the earth and more particularly to the identification of subsurface strata which are being drilled and the identification of subsurface strata which cave into the bore hole after the bore hole has been created by the drilling process.

BACKGROUND OF THE INVENTION

The rotary drilling process creates a bore hole in the earth by use of a drill bit which is attached to a drill stem. A drill stem consists of, from top to bottom, a kelly, drill pipe and drill collars. The drill bit and drill stem are lowered and rotated into the earth creating a bore hole by breaking, abrading and fracturing the earth beneath the drill bit. During this process drilling mud is circulated by means of a pump down the inside of the drill stem and up the annular space between the outside of the drill stem and the wall of the bore hole. The drilling mud removes the cuttings, cavings and other debris from the annular space. Cuttings are the chips of earth which are created by breaking, abrading and fracturing the earth beneath the drill bit. Cavings are the pieces of earth which have fallen or sloughed into the annular space from the bore hole wall. Other material such as oil, gas and water from the bore hole wall or from beneath the drill bit are also entrained in the drilling mud. Also, the contact between the bore hole wall and the drill stem and mechanical failure of the drill stem occasionally cause parts of the drill stem to be entrained in the drilling mud. The products of abrasion between casing and cement which holds the casing in place and the drill stem are occasionally entrained in the drilling mud.

Other functions of the drilling mud include cooling and lubricating the drill bit, and maintaining a hydrostatic pressure on the bore hole wall which is greater than the pressure in the earth. This hydrostatic pressure prevents uncontrolled flows of oil, gas and water from the earth into the bore hole.

Determining the composition of the earth at the site of the drill bit as it drills within the earth at the end of the drill stem is one of the major functions of the well site geologist. Typically, in the area where drilling occurs, layers of various rocks were deposited one on top of the other. These layers—or rock strata—are usually shale (a compacted form of clay or mud), sandstone (a compacted form of sand), limestone, dolomite, coal, salt, anhydride, and sylvite.

It is known that the task of identifying rock strata is aided by detecting the naturally occurring gamma radiation in the strata, which is produced (along with alpha and beta rays) when unstable radioactive elements in the rock strata decay into stable elements, thereby releasing gamma rays. After the well is drilled or during the critical phases of drilling, the gamma radiation can be measured by removing all the drill stem and the drill bit from the bore hole. Open hole tools are lowered on a cable to the bottom of the hole and then hoisted to the surface while recording the gamma radiation of the bore hole wall. A drawback of this technique is that well site personnel are required to wait until after the bore hole is drilled to a suitable depth and the drill stem and the drill bit are removed before gathering the bore hole gamma radiation data.

Another technique used to identify the composition of the earth at the site of the drill bit is to measure the drilling penetration rate to indicate hardness changes in the rock strata being drilled. However, the advent of new drilling bits which maintain a constant drilling penetration rate as the rock strata changes precludes the well site geologist from relying on this technique.

Another technique used to identify the composition of the earth at the site of the drill bit, which does not require removing the drill stem, is to visually examine the material entrained in the drilling mud circulated from the bore hole. This is costly, because it requires a geologist or other professional to be on-site during the drilling in order to maintain a detailed description of the entrained materials as they are circulated from the bore hole. Occasionally, rig personnel fail to collect the entrained material or collect it at the wrong time or mix up the samples. Also, modern drilling bits abrade the cuttings into very fine chips. Finely abraded chips are difficult to sample in the mud circulation system and are difficult to examine visually.

A difficulty with all techniques which analyze the material entrained in the drilling mud is that the physical characteristics, including the natural gamma radiation of the drilling mud, are constantly changing during the drilling operation. Drilling mud is generally a mixture of water, clay, barite and other chemicals which are designed to provide the properties which drilling personnel require for safe and economical drilling. Often drilling personnel use water for drilling and as the water is continuously circulated the clay or shale from the substrata is ground into fine particles which are suspended in the water. This drilling mud is called native clay drilling mud. Drilling personnel maintain and often change the characteristics of the drilling mud by adding water, drilling clay, barite (a material which increase the hydrostatic head) and other materials which alter the physical properties of the drilling mud or by using other drilling fluids. All these combinations are referred to as drilling mud herein. Occasionally the drilling mud is discarded so that other drilling mud can be introduced into the bore hole or the undesirable properties of the current drilling mud can be eliminated. These changes in the drilling mud have a dramatic effect on the gamma radiation readings measured in the mud return line. This is because the gamma radiation of the drilling mud is a high proportion of the total gamma radiation of the drilling mud combined with the entrained materials. For example, the clay used as a component of the drilling mud is bentonite that is generally three to four times more radioactive than the shales encountered while drilling and up to forty times more radioactive than the sandstone or limestone encountered while drilling. The drilling clay can be up to thirty percent of the drilling mud by volume, but typically is in the range of two to twelve percent by volume.

Other factors also vary the gamma radiation readings in the mud return lime. A large pumping rate for the drilling mud will result in larger gamma radiation readings in the mud return lime, since a larger volume per time is then flowing past the detector. Bentonite drilling mud varies in its pumping rate from two hundred to five hundred gallons per minute. Finally, the drilling rates typically encountered may vary between one half a minute per foot to five minutes per foot. A faster drilling rate will result in a larger gamma radiation reading than a slower drilling rate, since a larger volume of entrained materials is then moving past the detector.

Drilling rates vary from area to area and tend to be slower at deeper depths.

As can be seen, the composition of the drilling mud, the flow rate, the drilling rate and the volume and type of entrained material in the mud return line are constantly changing. These changes affect the gamma radiation measurements in the mud return line.

Yet another technique for determining the earth composition at the drilling bit, which does not rely on an analysis of the materials entrained in the drilling mud, is measure while drilling (known as MWD) gamma ray logs. MWD logs utilize gamma ray instrumentation placed in the drill collars near the drill bit. The instrumentation records and telemetries the gamma ray measurements to the surface and the data is processed and can be presented as a graph of natural gamma radiation versus depth.

MWD logging is effective, but is not available in many wells due to cost and logistics. Moreover, MWD logging tells nothing about caving of the bore hole wall into the bore hole, since it only measures the gamma radiation at the drill bit. Therefore, a process is desired that will produce an accurate measure of the gamma radiation at the drilling bit and also measure the gamma radiation of any caving into the bore hole.

SUMMARY OF THE INVENTION

The present invention is directed to a method of creating a compensated gamma ray mudlog while drilling. A gamma radiation detector is located in the mud circulation system to measure the gamma radiation of the drilling mud alone without any entrained materials, and another gamma radiation detector is located in the mud circulation system after material becomes entrained in the drilling mud (such as in the mud return line) in order to measure the gamma radiation of the drilling mud combined with the entrained material. The data is then processed to determine the gamma radiation attributable to the entrained material by subtracting the gamma radiation level of the drilling mud alone from the gamma radiation level of the drilling mud combined with the entrained material, so that the gamma ray measurement is thus "compensated". The gamma radiation of the entrained material is then "lagged" to the correct depth and place of the drill bit by accounting for the time it takes the drilling mud to travel from the drill bit to the sensor in the mud return line. A graphical presentation of the depth and the natural gamma radiation of the entrained material may be prepared. The gamma radiation of the entrained material thus determined, lagged to the depth and place of the drill bit, will correspond to the gamma radiation at the site of the drill bit, after adjusting the measurements for any cavings.

If a commercial MWD gamma ray log is available, then the time and location of any cavings can be determined by comparing the gamma radiation determined at the drill bit site determined in accordance with the present invention to the gamma radiation at the drill bit site determined with the MWD log. This, in turn, allows a determination of the composition of the caving material and the drilling conditions which exacerbate the caving process.

DESCRIPTION OF THE PREFERRED EMBODIMENT

Figure 1:
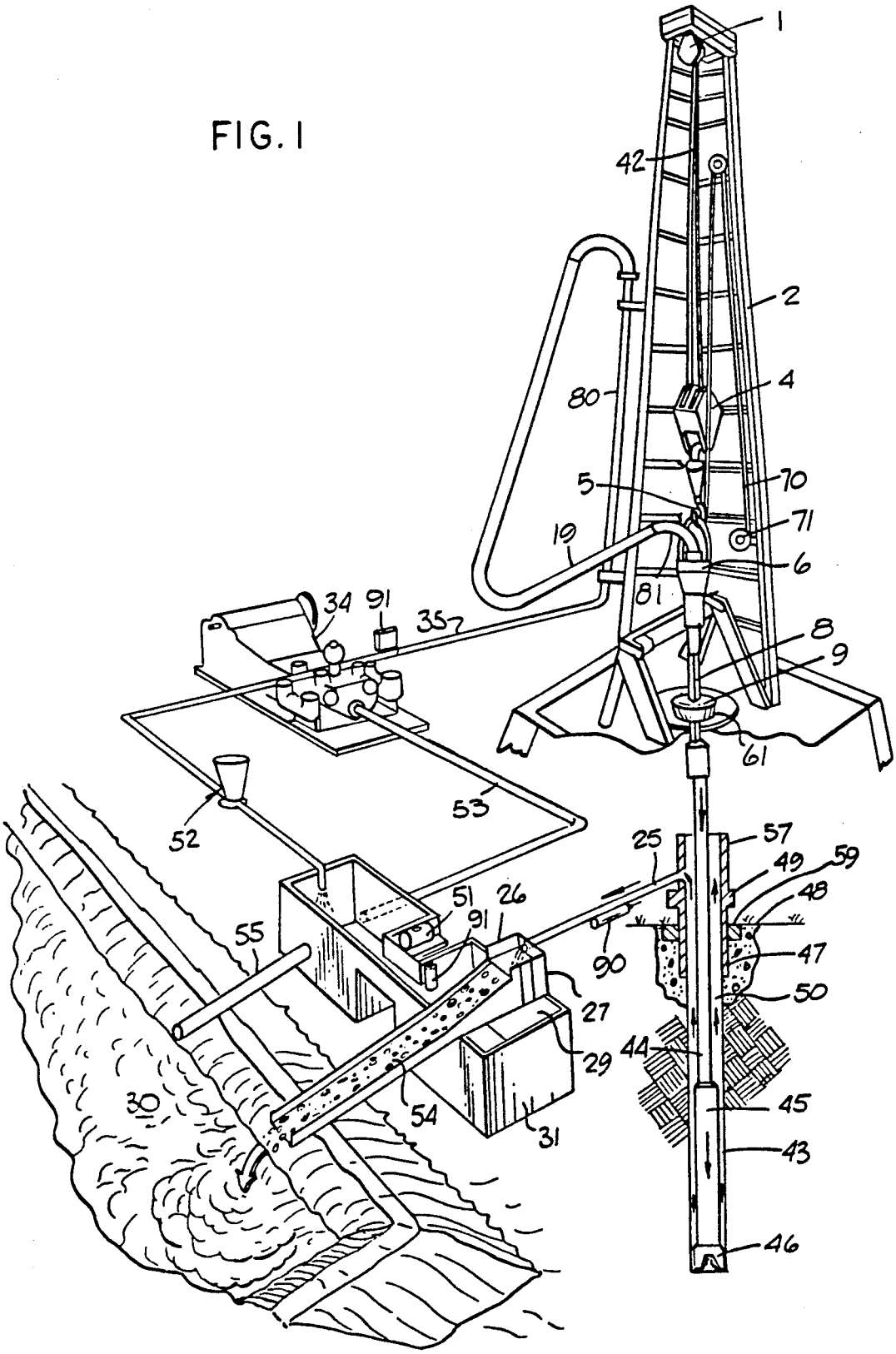
FIG. 1 is a representational view of a rotary drilling system with which the present invention may be utilized.

In accordance with the present invention a compensated gamma ray mudlog is continuously made during the well drilling operation. Referring to FIG. 1, a mast 2 is located over a bore hole 43 being drilled in the earth by rotary drilling. A drill stem which consists of a kelly 8, drill pipe 44 and drill collars 45 and which terminates in a drill bit 46 at the drill stem's lower end, is suspended within the bore hole 43. A prime mover (not shown) turns the rotary table drive (not shown), which turns the rotary table 61 and the kelly bushing 9. The kelly 8 is a long fluted or polygonal shaped axle. It is attached on one end to the drill pipe 44 and causes the drill pipe 44 and the entire drill stem and drill bit 46 to rotate. A hoisting mechanism consisting of a draw works (not shown), the crown block 1, the traveling block 4, hook 5, swivel 6 and the drilling line 42 enable the drill stem and drill bit 46 to be raised and lowered by moving the kelly 8. During drilling, the weight and rotary motion on the drill stem cause the drill bit 46 to create a bore hole 43 by breaking, abrading and fracturing the earth beneath the drill bit 46. As the drill bit 46 is lowered, a depth recording line 70 which is attached to the swivel 6 moves over a depth measuring device 71 which indicates the depth of the drill bit 46. During most drilling operations one or more strings of casing 47 are installed and cement 48 is placed about the casing 47.

The hoisting mechanism is used to connect more drill pipe 44 to the drill stem as the well is drilled deeper. During this process the drill pipe 44 is hoisted to the rotary table 61 and the kelly 8 is disconnected. During the lagging process more fully described below, radioactive material is introduced into the drill pipe 44 which is set upon the kelly bushing 9 during the connection process.

The mud system is a major part of the rotary drilling rig. The mud system is a closed system in which drilling mud is circulated. The heart of the mud system is the mud pump 34. Drilling mud 29 is pumped out of the mud pump 34 into the mud discharge line 35, up the standpipe 80, into the rotary hose 19 and goose neck 81. The goose neck 81 is connected to the swivel 6 which channels the drilling mud into the hollow center of the kelly 8. The drilling mud then travels down the kelly 8 into the hollow center of the drill pipe 44 and drill collars 45 to the drill bit 46. The drilling mud is pumped out the bottom of the drill bit 46 and entrains drill cuttings. The drilling mud then travels up the annulus 50 between the bore hole 43 and the outside of the stem. Cavings from the bore hole wall may be entrained in the drilling mud during its flow in this annular space.

The drilling mud 29 reaches the earth's surface and goes through the annulus 50 between the inside of the drilling spool 59 and blow-out preventer 49 and the outside of the drill stem. The drilling mud then flows up the annular space between the drilling nipple 57 and drill stem and out the mud return line 25 to the shale shaker box 27 and the shale shaker 26. The shale shaker 26 is a vibrating screen which removes the cuttings, cavings and other material which are entrained in the drilling mud and sends the solid material down the shaker slide 54 into the reserve pit 30. The drilling mud falls though the shale shaker screen into the mud tank 31 where it is reconditioned prior to being circulated again. The chemical tanks 51 add liquid drilling chemicals such as soda ash and caustic soda to the drilling mud, the mud mixing hopper 52 adds solid drilling material such as drilling clay, barite, starch, and guar gum, and the jetting line 55 disposes of excess drilling mud or drilling mud which does not meet the desired requirements set forth by the drilling rig personnel. The drilling mud then leaves the mud tank 31 via the suction line 53 and enters the mud pump 34.

Figure 2:
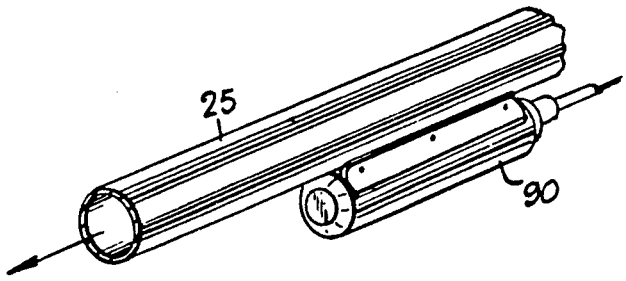
FIG. 2 illustrates a system used in the present invention for measuring the gamma radiation in the mud return line of the rotary drilling system of FIG. 1.

As shown in FIG. 2, a set of one or more gamma ray detectors 90 continuously monitor the gamma radiation at the mud return line 25 so as to measure the gamma radiation of all the material which is circulated out of the bore hole, including both the drilling mud and the entrained material. The material which is circulated out of the hole consists of drilling mud, cuttings, and to a lesser extent other material such as cavings, oil and gas, water, parts of the drill stem, parts of the casing, cement, or foreign material in the drilling mud.

Figure 3:
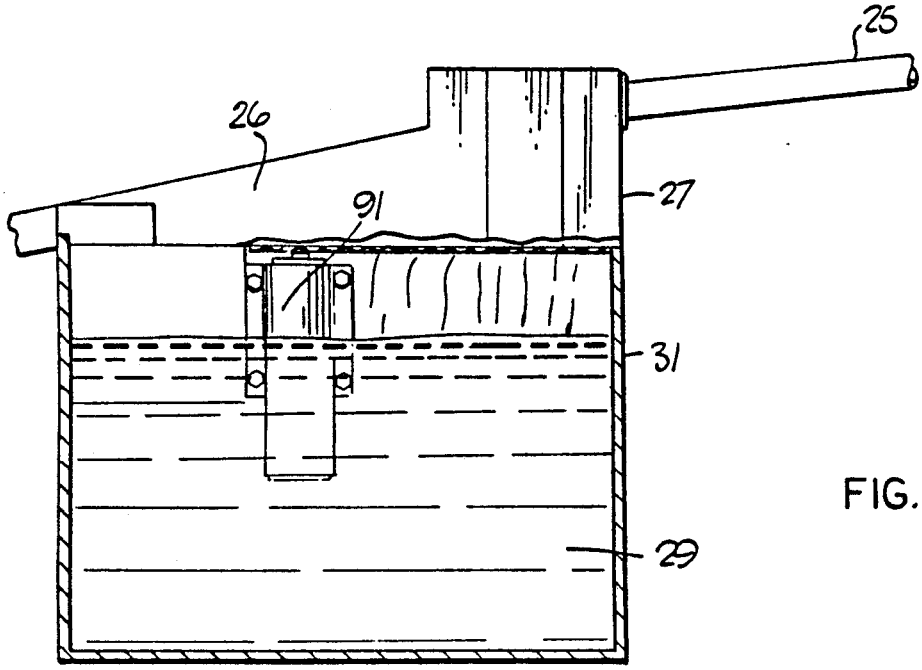
FIG. 3 illustrates a system used in the present invention measuring the natural gamma radiation in the mud tank of the rotary drilling system of FIG. 1.

As shown in FIG. 3, another set of gamma ray detectors 91 is placed so as to continuously measure the gamma radiation in the drilling mud 29 without the entrained material. This set of detectors 91 may be in the mud tank 31 downstream from the shale shaker 26. Alternatively, it may be in the mud system after the cuttings and other entrained material have been removed or settled out of the drilling mud, but before the characteristics of the drilling mud have been changed by mixing additional clay, water or other drilling mud additives which are added by the drilling rig personnel.

Any gamma ray detector capable of detecting the small amounts of natural gamma radiation is acceptable for these detectors. The detector preferred is a scintillation type spectrometer-detector (e.g. a sodium iodide, thallium activated crystal) with a photo multiplier tube. The spectrometer-detector depends on the fact that the three processes whereby gamma rays interact with matter (photoemission, Compton effect, and pair production) result in the production of energetic electrons whose total energy is exactly proportional to the original gamma ray energy. The electrons, in turn, lose energy by the ionization of the detector material to produce a number of ion pairs exactly proportional to the electron energy. The analysis of the pulse counts at the various energy levels may be used to determine the radioactive isotope responsible for the gamma ray emission and the elements in which the gamma ray emission interacted with prior to detection. For a more detailed discussion of the detector for use in determining the radioactive isotope responsible for the gamma ray emission see U.S. Pat. No. 4,578,579, by Dios. Suitable shielding, multiple detectors and various positioning schemes may be employed to reduce background radiation from other sources and to enhance the measurement of certain portions of the gamma radiation energy spectrum.

The gamma radiation of the entrained materials is computed by taking the difference between the gamma radiation of the drilling mud with the entrained materials as measured in the mud return line 25 and the gamma radiation of the drilling mud without the entrained materials as measured in the mud tank 31. This difference yields the gamma radiation of the cuttings combined with any other entrained material that may be in the drilling mud. The date, time of day, the detector readings, the computed difference, depth and drilling penetration are continuously recorded. The portion of the gamma radiation attributable to cavings and other entrained material other than cuttings is usually very small, and can usually be ignored. The depth of the drill bit 46 is known by either measuring the length of the drill stem as it is lowered in the bore hole 43 or by recording the rotations of a depth measuring device 71 as the drilling process occurs. The drilling penetration rate is computed by dividing the elapsed time by the elapsed depth.

The measurement of the gamma radiation of the entrained materials may be corrected to account for cavings in the entrained material. If a cavings correction is necessary, a function relating caving influx to the drilling mud circulation rate, drilling penetration rate and the bore hole surface area may be used. This functional relationship is not fixed but is derived from the review of the caliper logs and drilling information of wells previously drilled in the area.

The gamma radiation of the cuttings and to a lesser extent cavings or other entrained material captured by the shale shaker or settling process is then "lagged" to corrected depth by determining the lag time. As discussed above the drilling 29 mud is pumped down the inside of the drill stem and is circulated up the annular space between the bore hole 43 wall and the outside of the drill stem. Radioactive material is introduced into the drill pipe 44 at or near the kelly 8 and the time required to travel to the mud return line gamma ray detector 90 is measured. The time required for the radioactive material to travel from the point of introduction to the drill pipe 44 down to the drill bit 46 is subtracted from the time required for the material to travel from the point of introduction in the drill pipe 44 to the mud return line detector 90. The lag time is thus determined and defined as the time required for radioactive material to travel from the drill bit 6 to the mud return line detector 90 for a given depth and place of the drill bit. The above described procedure is repeated periodically during the drilling of the well. Because the depth at all times is known, the lag time at any depth and place can be determined by interpolating or extrapolating the lag time between the depths at which the lag time was actually measured in accordance with the above procedure.

Alternative methods of determining the lag time use liquid dyes or solid particles or gases which are detectable when they are circulated up the hole and into the surface portion of the mud system. These determinations of lag time can be compared against the theoretical lag time calculated by making some assumptions regarding the size of the annular space, the settling velocity of the drill cuttings and the flow rate of the drilling mud, as known in the art.

The gamma radiation of the entrained material at any depth, is equal to the compensated gamma radiation in the mud return line 25 at the time of measurement in the mud return line 25 minus the lag time. The depth at that time can be determined as described above. A continuous graph of depth and entrained material gamma radiation can thus be determined.

Another alternative placement of the set of detectors 91 which continuously monitor the gamma radiation of the drilling mud 29 without the entrained materials, is in the mud discharge line 35 or stand pipe 80. This alternative placement measures the gamma radiation after the characteristics of the drilling mud have been changed by the drilling rig personnel, but prior to the mud being pumped into the drill stem. If the drilling mud gamma ray detectors 91 are in the discharge line 35, then prior to subtracting the measurement of the drilling mud gamma ray detectors 91, the time required to pump the drilling mud to the drill bit must be computed. This measurement would then be lagged to the drill bit subtracted from the mud return line gamma ray detectors 90 in order to yield the gamma radiation of the entrained material.

Slight modifications to the procedure just described are required when deviated or lateral holes are drilled, when pauses or variations in the mud circulating rate are encountered or when the drilling rate changes.

Figure 4:
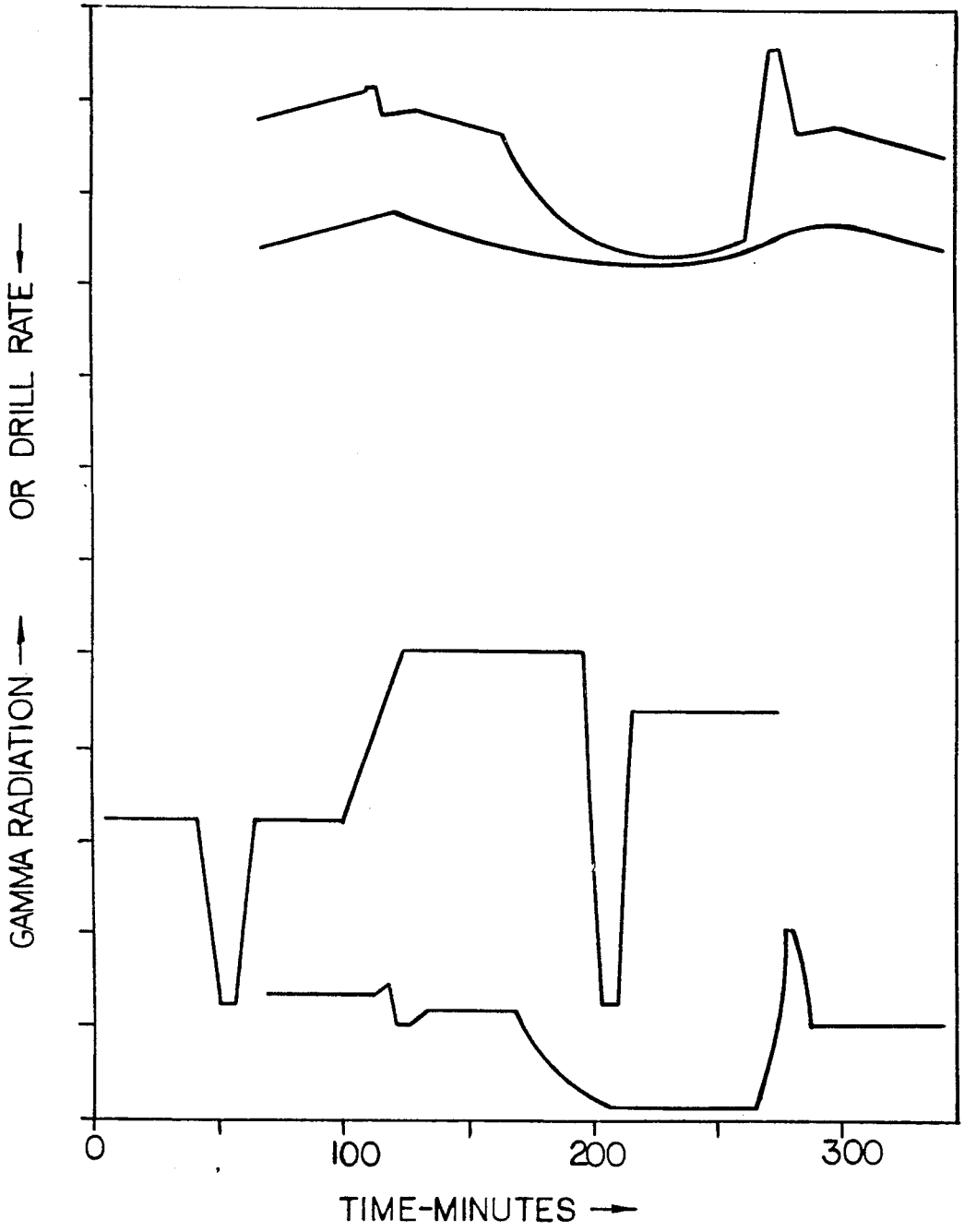
FIG. 4 illustrates the data obtained from the gamma radiation detectors used in the present invention, the computed drilling penetration rate, time, and the computed gamma radiation attributable to the entrained materials.

FIG. 4 is an example of the initially recorded data. In the example presented in FIG. 4, the drilling mud is composed of approximately two and one half percent bentonite and is pumped at a rate of approximately 300 gallons per minute, in a seven and seven eights' inch diameter hole. The drilling rate is between one half and one and three quarter minutes per foot drilled. The drilling mud is approximate fifteen times as radioactive as a limestone strata that is being drilled.

The top line FIG. 4 represents the gamma radiation measurements in the mud return line, which shows the gamma radiation of the entrained materials combined with the drilling mud. The second from the top line represents the gamma radiation measurements in the mud tank, which shows the gamma radiation of the drilling mud without the entrained materials. The bottom line represents the difference between the two measurements. The gamma radiation increases with increasing height along the vertical axis. The second from the bottom line is the drilling rate. The drilling rate decreases with increasing height along the vertical axis.

A review of FIG. 4 indicates that the gamma radiation of the drilling mud 29 as measured by the gamma ray detector 91 in the mud tank 31 contributes more than ninety percent of the total gamma radiation as measured in the mud return line gamma ray detector 90. A failure to compensate for the drilling mud's portion of the total gamma ray signal would therefore cause an erroneous interpretation of the data. It is also apparent that slight variations in the volume of drilling clay present in the drilling mud and/or the gamma radiation of the drilling clay have very significant effects on the mud return line detector 90 measurement.

Figure 5:
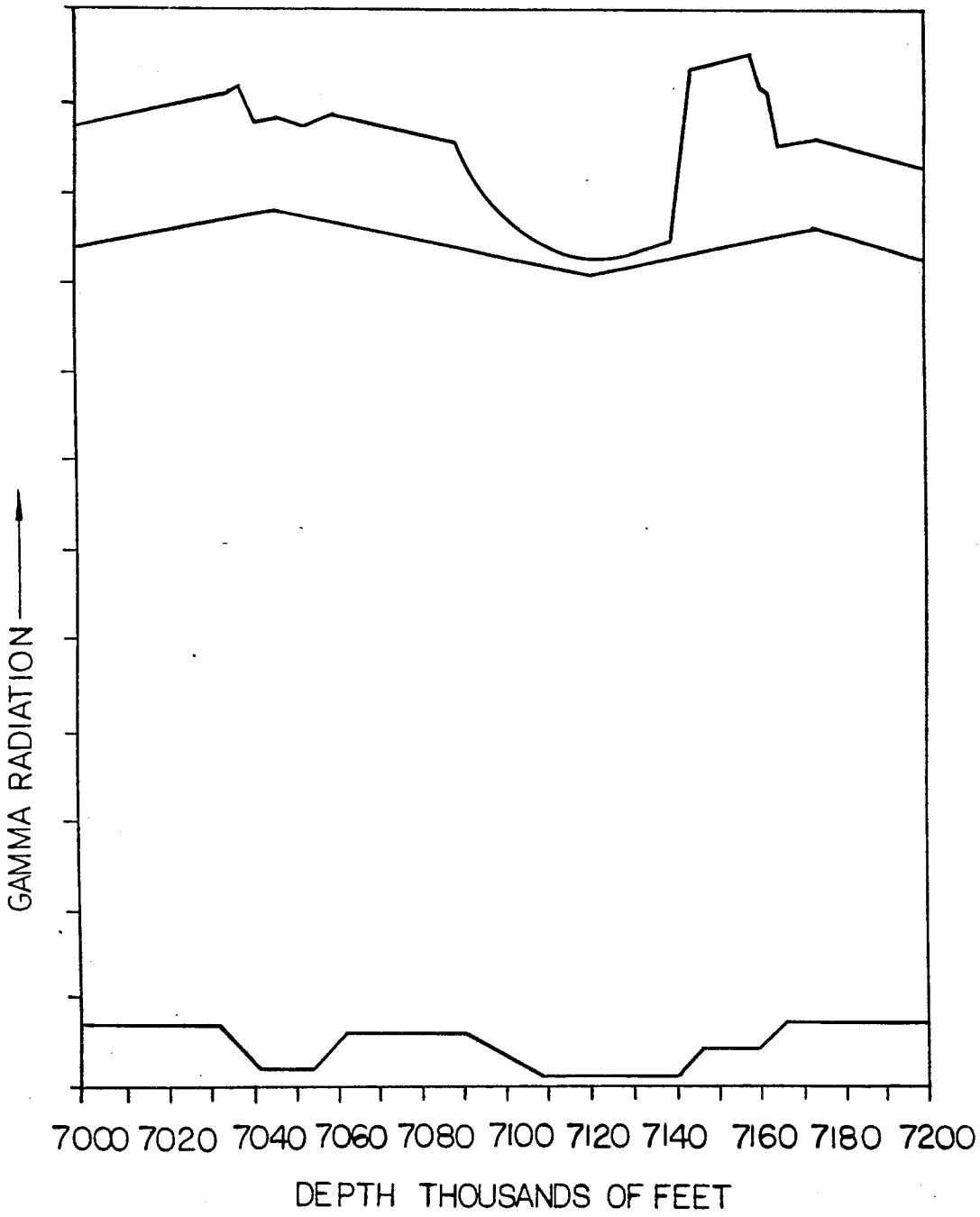
FIG. 5 illustrates a graphical presentation of the compensated gamma ray mudlog after the lagging and drilling rate correction process.
Figure 6:
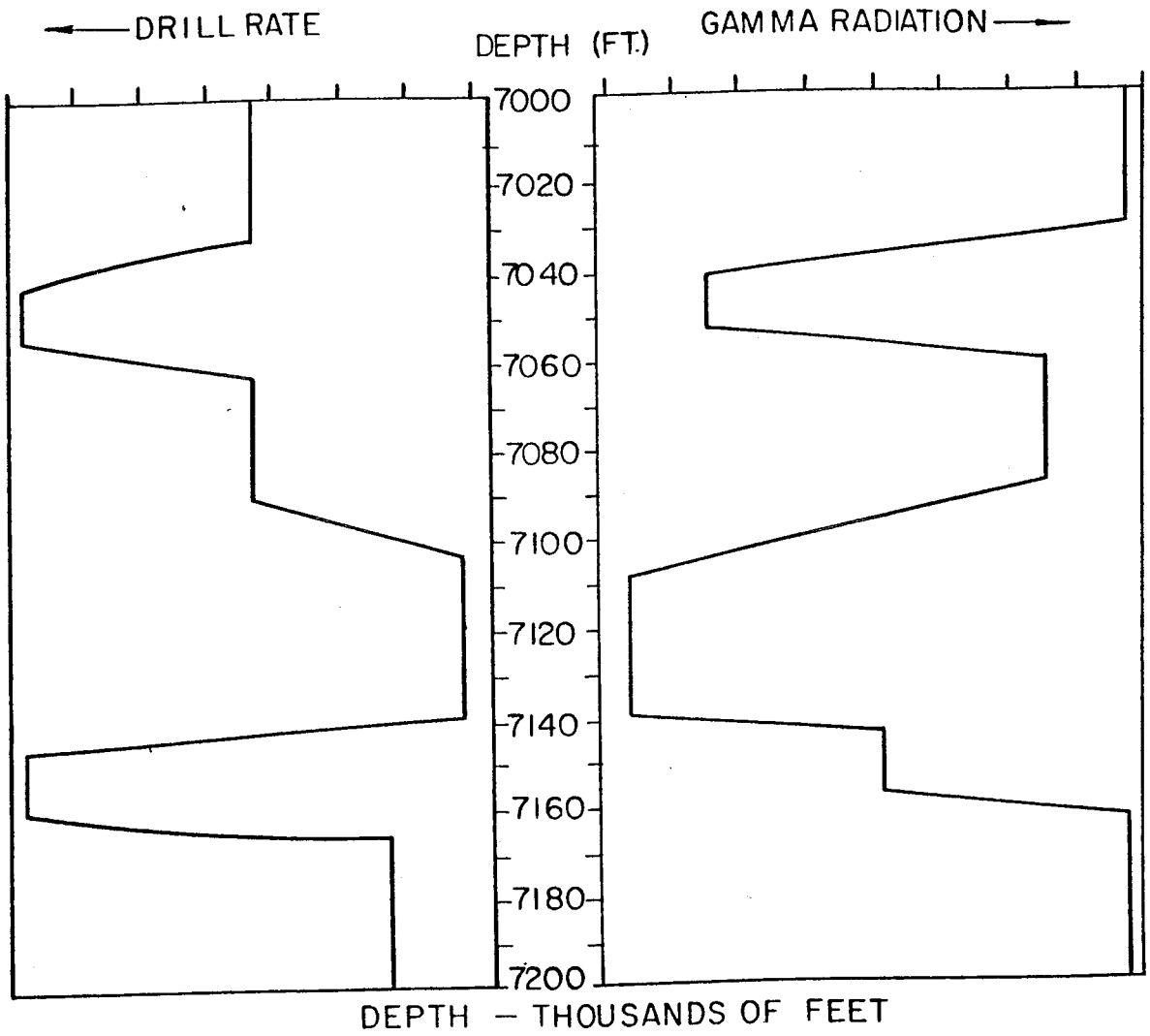
FIG. 6 illustrates a compensated gamma ray mudlog and drilling rate presentation generated in accordance with the present invention.

In the example illustrated by FIGS. 4, 5 and 6 the lag time was determined to be approximately one minute per every one hundred feet drilled. The lag time at the depth of seven thousand feet is seventy minutes; that is, it will take a rock chip cut by the drill bit approximately seventy minutes to reach the detector 80 in the mud return line 25. The lag time is a function of the depth, the pump rate, the drilling mud 29 and the complex interaction of forces acting on the rock chip.

FIG. 5 presents reconstructed data from gamma ray detectors lagged to the depth at which the cuttings were produced and adjusted for drilling penetration rates. Again, the top line is the gamma radiation measurement in the mud return line 25, the second from the top line in the gamma radiation measurement in the mud tank 31, and the bottom line is the difference between the two measurements. The lagging and drilling rate corrections can produce results not anticipated by the review of the mud return line detector data. Two zones should be reviewed carefully. The first is a limestone strata at 7040 to 7054 which appears distinctly in the bottom line. That strata cannot be easily discerned from a shale strata starting at 7054 if one reviews only the lagged gamma radiation measurement from the mud return line detector 90. This lack of definition is caused by very minor changes in the gamma radiation properties in the drilling mud 29 and variations in the drilling penetration rate. The second zone to review is the zone at 7146 to 7160. That strata appears to have high gamma radiation readings if the mud return line detector 90 is reviewed. The lagged compensated gamma radiation data indicates the gamma radiation to be less than that of the rock strata immediately below. However, a review of the drilling penetration rate in FIG. 4 at approximately 200 minutes indicates this zone was drilled very rapidly. The rapid drilling caused the amount of cuttings measured by the mud return line detector 90 to increase dramatically. The rapid drilling caused more volume of relatively low radioactive rock strata to be measured by the mud return detector 90. Therefore, the high gamma radiation measurements at that point do not actually represent high gamma radiation at the drill bit site, but simply reflect the fast drilling rate. Accordingly, the bottom line in FIG. 5 shows no peak at this point after accounting for the drilling rate.

FIG. 6 presents the lagged compensated data (gamma radiation) in the right-hand line and the drilling rate (drilling rate) in the left-hand line in a graphical format. The depth is indicated down the middle. The data presented herein is idealized data of a well drilled in Weld County, Colorado. Four strata are identifiable from these graphs. Down to 7100 feet is the Niobrara, from 7100 to 7140 is the Fort Hayes, from 7140 to 7160 is the Codell, and from 7160 to 7200 is the Carlile. The two areas of particular interest are from 7040 to 7054 and from 7145 to 7160. These two areas show fast drilling rates and relatively low gamma radiation, both of which tend to indicate the potential presence of a hydrocarbon bearing strata.

Figure 7:
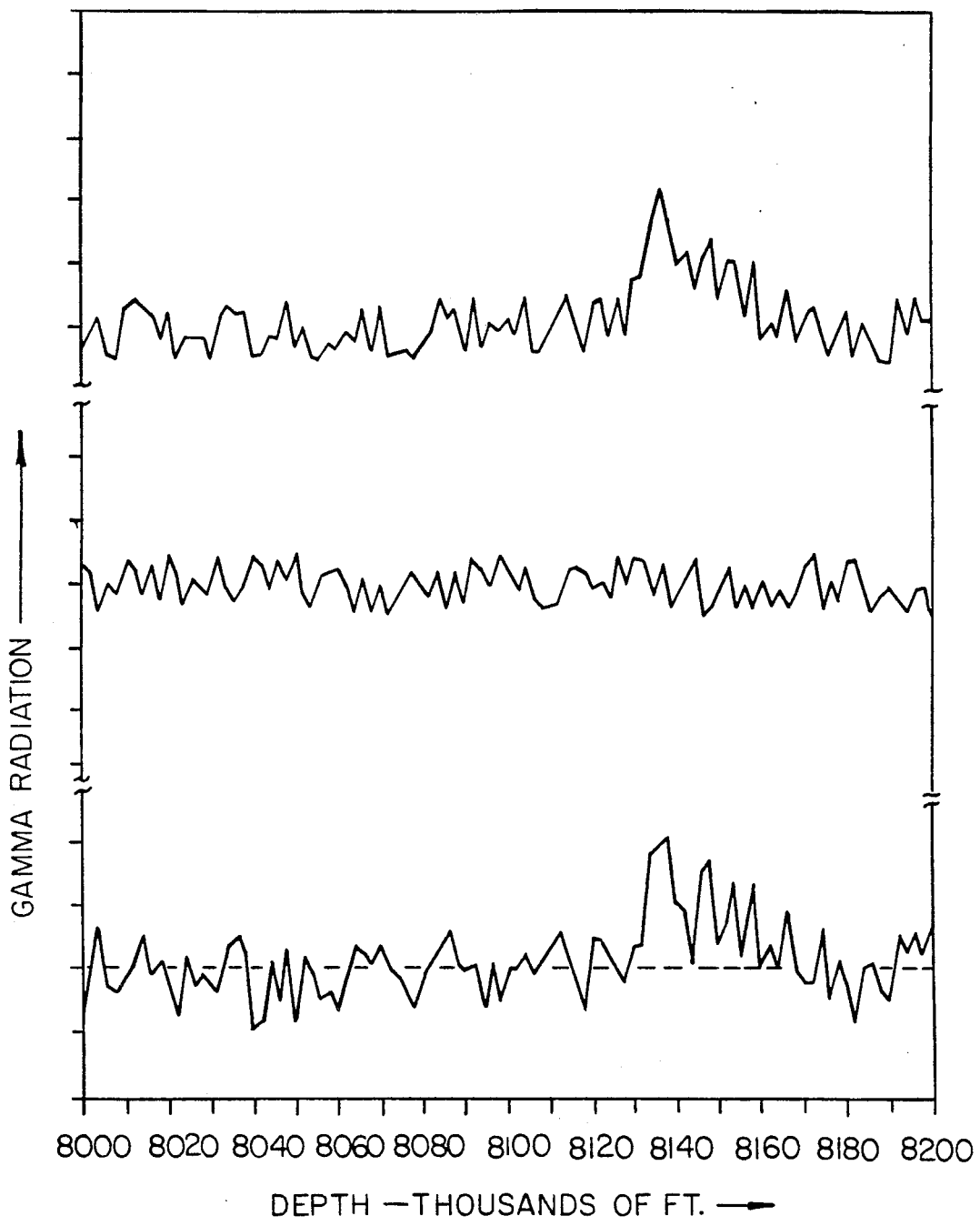
FIG. 7 illustrates the determination of zones which cave by using the MWD gamma ray log and the compensated gamma ray mudlog of the present invention.

FIG. 7 compares the MWD gamma ray log with the compensated gamma ray mudlog of the present invention. The MWD gamma ray log measures the gamma radiation at the drill bit. The compensated gamma ray mudlog of the present invention measures the gamma radiation of the entrained material. This entrained material consists of the cuttings that become entrained at the drill bit plus any cavings that become entrained as the mud travels up the annulus. If the two measurements correspond, then it can be assumed there were no cavings as the mud traveled up the annulus. If the two measurements do not correspond, then the difference represents cavings. In the example of FIG. 7, the top line represents the gamma radiation as determined in accordance with the present invention, the middle line represents the gamma radiation as determined with a MWD gamma ray log, and the bottom line is the difference between the two. The spikes in the zone at 8130 to 8160 introduced cavings to the drilling mud. The cavings are indicated by the compensated gamma ray mudlog showing higher gamma radiation readings than the MWD gamma ray log.

What is claimed is:

1. A method for determining gamma radiation of a bore hole which is drilled with the aid of drilling mud that is circulated through the bore hole to entrain material from the bore hole, comprising:

measuring the gamma radiation of the drilling mud with the entrained material;

measuring the gamma radiation of the drilling mud without the entrained material;

adjusting at least one of said measurements of gamma radiation to account for the drilling rate; and computing the different between the gamma radiation measurement of the drilling mud with the entrained material and the gamma radiation measurement of the drilling mud without the entrained material.

2. The method of claim 1, further comprising adjusting the measurement of gamma radiation of the drilling mud to account for changes in the drilling mud circulation rate.

3. The method of claim 1, further comprising plotting the determined gamma radiation against bore hole depth.

4. The method f claim 1, wherein the actual vertical depth of the bottom of the bore hole is determined after correcting for any non-vertical portions of the bore hole.

5. A method for determining gamma radiation at the bottom of a bore hole which is drilled with the aid of drilling mud that is circulated through the bore hole to entrain material from the bore hole bottom, comprising:

measuring the gamma radiation of the drilling mud with the entrained material;

measuring the gamma radiation of the drilling mud without the entrained material;

computing the difference between the gamma radiation measurement of the drilling mud with the entrained material and the gamma radiation measurement of the drilling mud without the entrained material;

obtaining a Measurement While Drilling gamma radiation measurement in the bore hole; and comparing said Measurement While Drilling gamma radiation measurement with the gamma radiation at the bottom of the bore hole determination to determined the occurrence of caving in the bore hole.

6. The method of claim 5, wherein a discrepancy in the Measurement While Drilling gamma radiation measurement and the gamma radiation at the bottom of the bore hole determination made in accordance with claim 9 is attributed to caving.

7. The method of claim 6, further comprising determining the gamma radiation of the caving by measuring the difference between the Measurement While Drilling gamma radiation measurement and the gamma radiation measurement at the bottom of the bore hole determination made in accordance with claim 9.

8. A system for determining the gamma radiation at the bottom of a bore hole which is drilled with the aid of drilling mud circulated through the bore hole to entrain material from the bore hole bottom, comprising:

means in the drilling mud circulation system for measuring the gamma radiation of the drilling mud with the entrained material;

means in the drilling mud circulation system for measuring the gamma radiation of the drilling mud without the entrained material;

means for adjusting the gamma radiation measurement of the drilling mud to account for changes in drilling rates;

computation means to determine the bore hole depth at the time the drilling mud circulated past the bore hole bottom; and computation means to determine the difference between the gamma radiation measurement of the drilling mud with the entrained material and the gamma radiation measurement of the drilling mud without the entrained material at a chosen bore hole depth.

9. The system of claim 8, further comprising plotting means electronically connected to said measurement means to plot said difference in said measurements against bore hole depth.

10. The system of claim 8, further comprising a Measurement While Drilling apparatus to determine the gamma radiation at the bore hole bottom, whereby the Measurement While Drilling gamma radiation measurement can be compared against said difference in measurements to determine the occurrence of caving in the bore hole.

* * * * *